US005228835A

United States Patent [19]

Chlus

[11] Patent Number: 5,228,835

[45] Date of Patent: Jul. 20, 1993

[54] GAS TURBINE BLADE SEAL

[75] Inventor: Wieslaw A. Chlus, Wethersfield, Conn.

[73] Assignee: United Technologies Corporation, Hartford, Conn.

[21] Appl. No.: 981,146

[22] Filed: Nov. 24, 1992

[51] Int. Cl.[5] ..... F01D 5/26

[52] U.S. Cl. ..... 416/193 A; 416/220 R; 416/500

[58] Field of Search ..... 416/193 A, 219 R, 220 R, 416/500

[56] References Cited

U.S. PATENT DOCUMENTS 3,037,741 6/1962 Tuft ..... 416/193 A
4,177,013 12/1979 Patterson ..... 416/193 A
4,457,668 7/1984 Hallinger ..... 416/95
4,505,642 3/1985 Hill ..... 416/193 A
4,516,910 5/1985 Bouiller et al. ..... 416/190
4,524,980 6/1985 Lillibridge et al. ..... 277/199
4,872,810 10/1989 Brown et al. ..... 416/193 A

*Primary Examiner*—Edward K. Look
*Assistant Examiner*—Michael S. Lee
*Attorney, Agent, or Firm*—Edward L. Kochey, Jr.

[57] ABSTRACT

An underplatform damper contact portion 54 is rigid, and provides a loose seal between the underplatform cooling air 46 and the gas stream 40. At the aft end of the blade platform the pressure difference increases and a more effective seal is provided by the snap-in flexible seal 71.

5 Claims, 3 Drawing Sheets fig.3
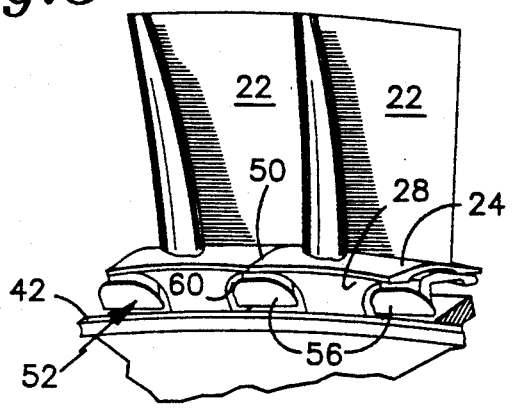
fig.4
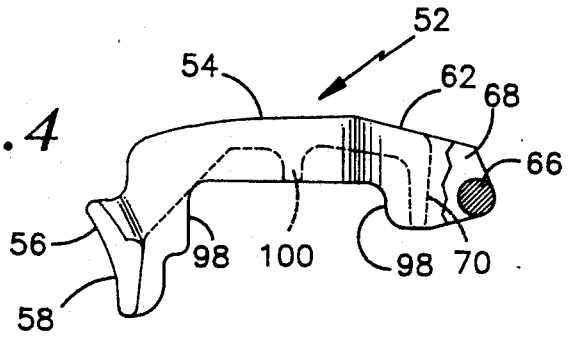
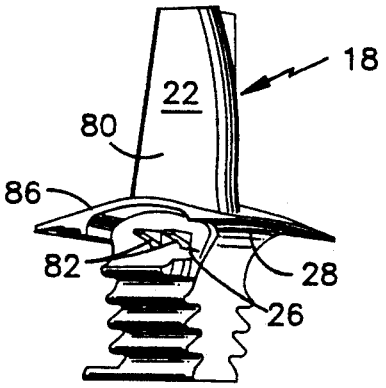
fig.6
fig.5
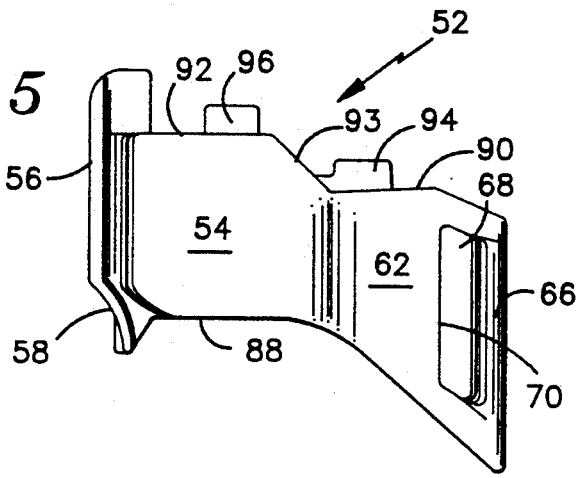

fig. 7
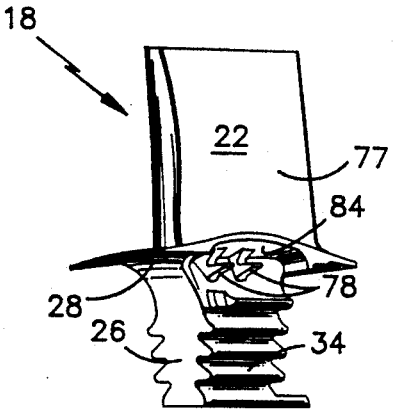
fig. 8
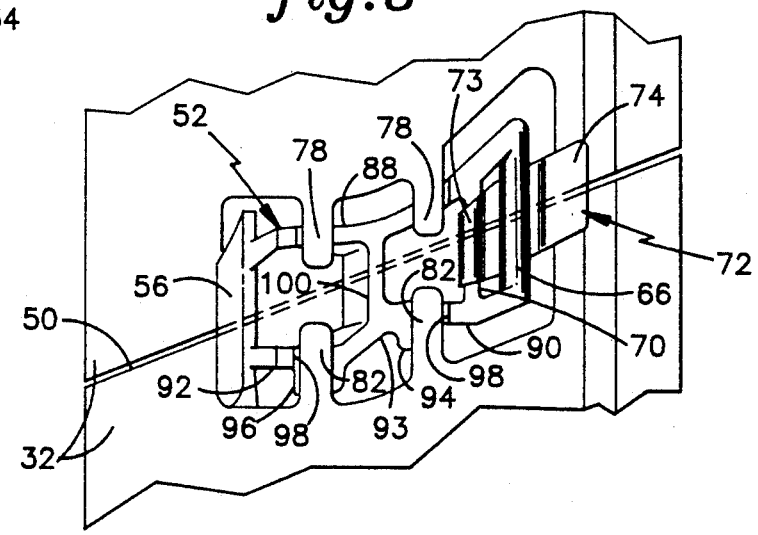
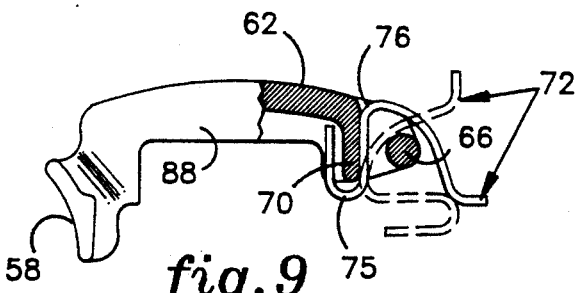
fig. 9
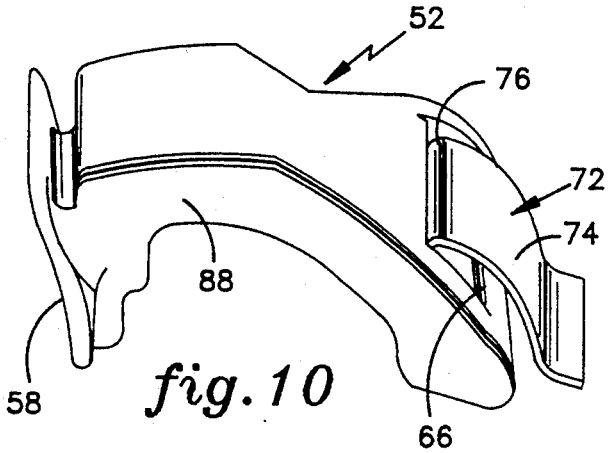
fig. 10

GAS TURBINE BLADE SEAL

TECHNICAL FIELD

The invention relates to gas turbine engines and in particular to damping of turbine blades and reducing leakage between blade platforms.

BACKGROUND OF THE INVENTION

In a gas turbine engine airfoil blades are secured to a turbine disk and driven by hot high pressure gas. The blades are airfoils with a neck connecting each airfoil to a root securing the blade to the disk. This root is often of the dove-tail type sliding into the disk axially or obliquely to the axis.

At the base of each airfoil and above the neck is a blade platform. In high temperature turbines this is frequently segmented with each blade being independent of the adjacent blade. The blades are therefore susceptible to vibration which can lead to a high level of repeated stress. Damping of the vibration of each blade is required to avoid these high levels of repeated stress.

The blades operate with high forces and at high temperatures, approaching the limits of the material. The blades accordingly are cooled with lower temperature air and the particular loading on the blade is a concern.

The turbines operate at high rotational speed such as 15,000 rpm which leads to a high centrifugal force in the order of 70,000 G. This produces a high load on the root and also high loading in the disk. Therefore the weight of the components secured to the disk is of concern, not only as to total engine weight but also as to the disk loading caused by the rotational forces. The high disk loading leads to larger disk and even more engine weight.

SUMMARY OF THE INVENTION

A gas turbine has a disk carrying a plurality of blades. A front rotor seal and a rear rotor seal block a portion of the cooling flow which would otherwise pass beneath the blades. The blade has an airfoil and a blade platform thereunder. The platform has a side edge on the concave side of the blade and a side edge on the convex side of the blade, these being parallel to each other with a clearance between adjacent platforms. An integrated damper and windage cover is located under this clearance.

The elongated damper is rigid and has a flexible seal secured to the aft end. The damper contacts the underside of two adjacent blade platforms.

BRIEF DESCRIPTION OF THE FIGURES

FIG. 3 is a front view of the damper in place;
FIG. 4 is a side view of the damper;
FIG. 5 is a top view of the damper;
FIG. 6 shows the concave side of the blade;
FIG. 7 shows a convex side of the blade;
FIG. 8 is a top view showing the damper in place.
FIG. 9 is a side view showing installation of the seal;
and
FIG. 10 is an isometric view of the damper and seal.

DESCRIPTION OF THE PREFERRED EMBODIMENT

Figure 1:
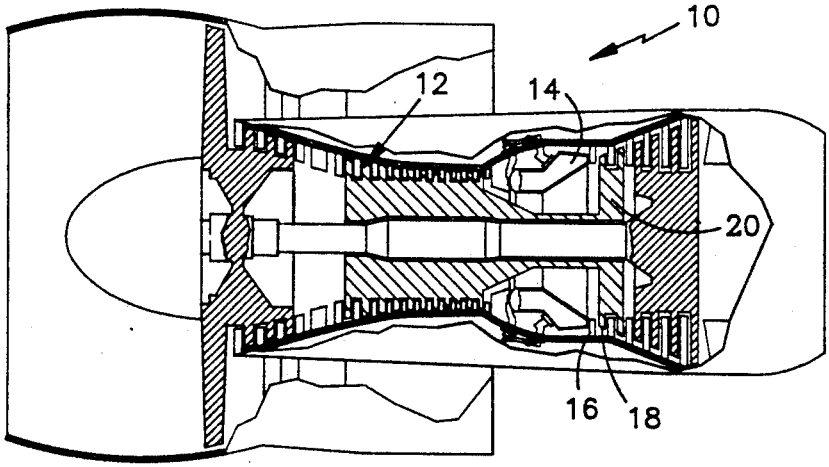
FIG. 1 is a view of a gas turbine engine.
Figure 2:
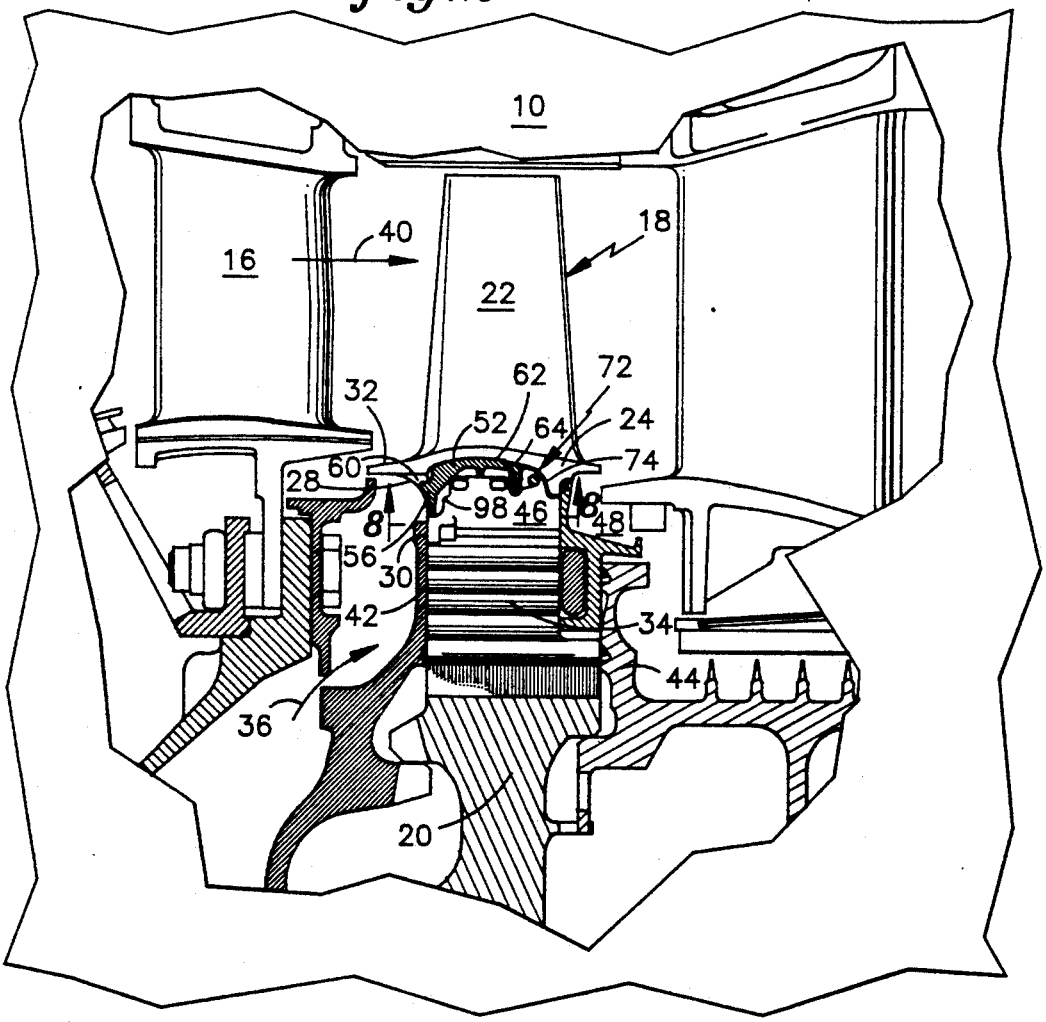
FIG. 2 is a side section of the damper in place.

In FIG. 1 there is illustrated a gas turbine 10, where compressor 12 delivers air at high pressure to combustor 14. The combustion gasses at high pressure pass through vanes 16 driving blades 18 which are secured to disk 20. Referring to FIG. 2 it can be seen that blade 18 includes an airfoil 22 with a blade platform 24 thereunder. A root 26 (as shown in FIG. 6) is located below the platform. This is substantially an extension of the airfoil shape to provide an appropriate load path through the neck. An upstream underplatform filet 28 of a generous radius is located to fair into the face 30 of the neck. This provides an appropriate load path to transfer the high centrifugal loading of the cantilevered upstream portion 32 of platform 24. Below the neck is root 34 of a dovetail form which is secured to corresponding dovetail openings in disk 20.

A flow of cooling air 36 is supplied from the compressor discharge with a portion of this flow passing through an opening not shown 38 to prevent ingestion of hot gas from the gas flow 40. An upstream rotor seal 42 and a downstream rotor seal 44 block any flow of cooling air through the blade connection area in the root portion 34 of the blades. It can be seen that an opening exists between adjacent blades between filets 28 into the underblade zone 46 beneath the blade platforms of adjacent blades. The rear rotor seal 44 operates to prevent the flow of this cooling air to the downstream volume 48. Potential leakage of this air may occur between adjacent blade platforms through clearance 50 (FIG. 3).

In some prior art cases, seals are applied in a machined shelf to prevent air flow through the opening 50. Here it is desirable that the upstream section of this opening be restricted but not completely sealed. It is desirable to have sufficient cooling air flow to cool the platform, while excess flow would result in an efficiency loss. The cooling air pressure is pegged to the gas stream pressure by the pressure difference through an opening not shown 38. Little pressure difference exists between zone 46 and the gas stream. A tight seal at this upstream end is not desirable, so that blade platform cooling air may pass. At the downstream side of the blade the gas side pressure has substantially decreased. The pressure difference producing flow through opening 50 has increased to produce an unacceptable high flow. Better sealing is desired at this location. Excess flow due to inadequate restriction of the opening 50 could result in gas bypassing from stream 40 between platforms 24 at the upper end returning to the gas stream at the downstream end of the platform.

Extension of the damper contact portion rearward to continue sealing of interplatform opening 50 has several negative aspects. The stiffness desired for damping is incompatible with flexibility desired for the improved sealing against the higher pressure difference. The tolerances required to seal the accurate damper against the accurate underplatform surface cannot easily be maintained.

Underblade damper 52 is shown alone in FIGS. 4 and 5 and as installed in FIGS. 2 and 3. The damper has a contact portion 54 and a windage cover portion 56. The contact portion is designed to establish line contact with the bottom surface of the platform. Because of the damping function and limited sealing requirement, this damper portion should be rigid as compared to a usual seal.

The windage cover portion 56 is cantilevered from the upstream end of the contact portion 54. It is shaped with curvature 58 which is the same curvature as the underblade filet 28. It is located between the adjacent blades with the cover portion surface defined by filet 58 substantially in alignment with the surface of the underplatform filet 28 of adjacent blades. In the installed position this windage cover portion 56 is free of contact with platform 24 and specifically the cantilevered portion 32 thereof. The maintenance of this free space 60 avoids any possibility of loading of the already high loaded cantilevered portion 32 by the vibration damper.

The contact portion of each damper has a damping surface 62 which is arcuate and conforming to the underplatform surface 64 of the blade. This is located to rub against two adjacent blade platforms. With the engine rotating at 15,000 rpm and the mass of the damper being 4.7 gms, a force of 3150 newtons is exerted against the underside of the adjacent dampers. If the damper has insufficient weight it will not create enough friction to damp the blades. If it has too much weight it will lock up on one or the other, or possibly both platforms and therefore be ineffective.

The contact portion 54 of the damper has at the aft end a rail 66 with a space 68 between the rail and a continuation of the contact surface 62. A rear rib 70 is radially extensive and adjacent the rail 66. As shown in FIGS. 8, 9 and 10, seal 72 has a retention lip 73 engaging rib 70. The seal has a sealing portion 74 formed to approximately the shape of underplatform surface 64. Space 75 is provided between lip 73 and the bottom of rib 70. Bend 76 is sharply formed and located close to the contact surface 62 of the damper. Under the influence of centrifugal force the corner 76 becomes sharper and space 76 partially closes. Leakage adjacent the bend adjacent bend 76 is therefore decreased.

The sealing portion 74 has a thickness less than 0.5 mm. It is sufficiently flexible to seal against the underside of adjacent blade platforms even with some mismatch. It is loosely secured to the damper so that binding of the seal to a platform does not deter damping by the damper.

FIG. 7 shows the concave side 77 of the blade 18. Since the high load from the airfoil 22 must be transmitted to the root 34, the neck 26 of the blade is substantially a continuation of the airfoil shape of the airfoil. Circumferentially extending blade tabs 78 are provided on the root for location and retention of vibration damper 52. FIG. 6 illustrates the convex side 80 of blade 18. The neck 26 carries blade tabs 82 for retention of the vibration damper.

The concave side of the blade shown in FIG. 6 has a concave side platform edge 84 while in FIG. 6 the convex side of the blade has a convex side platform edge 86.

Referring to FIG. 5 which shows a top view of the vibration damper 52, the contact portion 54 of the damper has a side edge 88 of concave shape substantially fitting the convex portion of neck 26 of a blade. The other side of the damper has a first step 90 and a second step 92 with a sloped portion 93 therebetween. Tabs 94 and 96 are located on these steps for the purpose of positioning the damper circumferentially, and for preventing contact between the windage cover portion and the blade.

Furthermore the steps 90 and 92 are not precisely axial, but vary between 2° and 3°, preferably about 2½° from such axial direction. Going from right to left on the top view illustrated step 90 is 2½° to the left while step 92 is 2½° to the right. This is for the purpose of maintaining a line contact between the contact portion and the underside of the platform.

For installation the seal, as shown in phantom in FIG. 9, is snapped into the damper. All blades for the turbine stage are held at the edge of the dovetails, the dampers placed between them, and all are simultaneously slid axially into position. The seal is held in position during the operation by its snapped in relationship.

FIG. 8 illustrates the location of underblade damper 52 with respect to an opening 50.

I claim:

1. A gas turbine engine having a disk and a plurality of blades, each blade having a airfoil, a blade platform, a neck, and a root, the root of each blade secured in said disk, the platform of each blade being independent of the other;

a seal arrangement comprising:

a rigid damper disposed in an underblade zone and in contact with adjacent platforms; and a flexible seal located downstream of said rigid damper, said seal being clipped to said rigid damper and in contact with said adjacent platforms at a location downstream of said rigid damper.

2. In a gas turbine engine having a disk and a plurality of blades, each blade having a airfoil, a blade platform, a neck, and a root, the root of each blade secured in said disk, the platform of each blade being independent of the other;

a seal arrangement comprising:

a rigid underblade damper in contact with the underside of two adjacent blade platforms; and a flexible seal, clipped to said damper and in contact with said two adjacent platforms at a location downstream of said rigid damper.

3. An arrangement as in claim 2, further comprising:

a rib on the underside of said rigid damper near the downstream end of said damper extending in a direction circumferential of said disk;

a lip on the upstream end of said seal in the form of a 180 degree bend engaging said rib.

4. An arrangement as in claim 3, wherein:

a clearance exists between the innermost portion of said rib and said 180 degree bend of said seal, when said seal is in contact with the underside of said adjacent platforms.

5. An arrangement as in claim 4, wherein:

said flexible seal has a thickness of less than 0.5 mm.

* * * * *